US011118782B2

(12) United States Patent
Fuller et al.

(10) Patent No.: US 11,118,782 B2
(45) Date of Patent: Sep. 14, 2021

(54) COLORED FLAME EMITTING DEVICE

(71) Applicant: WET, Sun Valley, CA (US)

(72) Inventors: Mark Fuller, Studio City, CA (US); Garrett Young, Sun Valley, CA (US)

(73) Assignee: WET, Sun Valley (CA)

( * ) Notice: Subject to any disclaimer, the term of this patent is extended or adjusted under 35 U.S.C. 154(b) by 107 days.

(21) Appl. No.: 16/359,892

(22) Filed: Mar. 20, 2019

(65) Prior Publication Data

US 2020/0300456 A1 Sep. 24, 2020

(51) Int. Cl.
*C11C 5/00* (2006.01)
*F23C 99/00* (2006.01)

(52) U.S. Cl.
CPC ..... *F23C 99/001* (2013.01); *C11C 5/004* (2013.01)

(58) Field of Classification Search
CPC ..... F23C 99/001
USPC ..... 431/4, 126
See application file for complete search history.

(56) References Cited

U.S. PATENT DOCUMENTS 2,645,279 A * 7/1953 Rossmann ..... F02C 3/305 417/50
3,811,817 A * 5/1974 Mansnerus ..... F23Q 2/44 431/126
5,267,849 A * 12/1993 Paciorek ..... F24C 3/103 431/6
2011/0008025 A1* 1/2011 Lee ..... H05H 1/42 392/307
2013/0291552 A1* 11/2013 Smith ..... F23C 99/001 60/779
2014/0099253 A1* 4/2014 Kulish ..... H01F 7/0294 423/649
2014/0272730 A1* 9/2014 Krichtafovitch ..... F23C 99/001 431/6

* cited by examiner

*Primary Examiner* — Avinash A Savani
(74) *Attorney, Agent, or Firm* — Maceiko IP

(57) ABSTRACT

A device that emits colored flames is disclosed. The device may include one or more electromagnetic coils within a housing. A fuel source may provide fuel such as hydrogen to an igniter at the input to the electromagnetic coil. The fuel may be ignited and a current may flow through the coil that may create a magnetic field. The ignited fuel may ionize creating an electric current that may accelerate the combusting particles through the coil. The current may create a magnetic field that may force the ionized particles into cyclotron orbits. Coloring additive such as salts may be added to the combusting fuel to provide color to the resulting flames.

17 Claims, 4 Drawing Sheets

COLORED FLAME EMITTING DEVICE

COPYRIGHT STATEMENT

This patent document contains material subject to copyright protection. The copyright owner has no objection to the reproduction of this patent document or any related materials in the files of the United States Patent and Trademark Office, but otherwise reserves all copyrights whatsoever.

FIELD OF THE INVENTION

This invention relates to flame emitting devices, including colored flame emitting devices, and their use in displays, such as displays with visual, audio and other effects.

BACKGROUND OF THE INVENTION

Colored flame displays and devices have been used for pyrotechnic effects such as for stage productions, fireworks, safety lighting/flares and for other purposes.

However, the physical size of the colored flames emitted by existing devices is generally limited (e.g., to a few feet). In addition, existing devices do not provide a broad spectrum of primary colors and in-between hues.

Accordingly, there is a need for a colored flame emitting device that provides larger colored flames.

There is also a need for a colored flame device that provides extended colors and hues.

There is also a need for a colored flame device that may be used in connection with displays, in order to enhance the visual effects thereof.

SUMMARY OF THE INVENTION

The present invention is described in the Detailed Description of the Preferred Embodiments, as well as in the claims, appearing later. The following Summary of the Invention describes aspects of the present invention.

An aspect of the invention regards a device that emits colored flames. The device may include a fuel source, an ignition assembly, a flame coloring assembly an accelerator and a controller to control the functions of the foregoing. The device may also include a chamber or other packaging to position the foregoing components with respect to one another. In this aspect of the invention, fuel is ignited, a coloring agent is added and the ignited fuel/coloring agent mixture is directed to an accelerator which may emit the colored flames from the device. The colored flames emitted from the device of the present invention are preferably physically longer than flames provided by existing emitting devices, and may also last for a longer time.

Another aspect of the invention regards the addition of an inter gas, such as argon, to slow down the combustion reaction upon ignition so that the emitted colored flame may have a longer duration.

Another aspect of the invention regards the addition of coloring agents, such as salts, which impart a color to the flame emitted from the device. To this end, the invention may emit colored flames of variable colors and hues.

Another aspect of the invention regards the use of a controller to control the timing of the ignition, coloring agent addition and acceleration.

Another aspect of the invention regards including the colored flame emitting device into a display, to enhance the visual and other effects of such display.

Other aspects of the present invention are described herein.

BRIEF DESCRIPTION OF THE DRAWINGS

Various other objects, features and attendant advantages of the present invention will become fully appreciated as the same becomes better understood when considered in conjunction with the accompanying drawings, in which like reference characters designate the same or similar parts throughout the several views, and wherein.

DETAILED DESCRIPTION OF THE PREFERRED EMBODIMENTS

A device according to exemplary embodiments of the current invention is described with reference to the figures.

In general, and in some exemplary embodiments hereof, the device 10 may emit colored flames. The flames may be created by igniting a fuel to cause combustion and/or an explosion. The colors may be created by including additives within close proximity to the burning and/or exploding fuel that may emit visible colors upon thermal excitation. The reaction may occur in a chamber that may generally control the reaction and that may direct the colored flames in a desired direction(s). The colored flames may also be accelerated in a desired direction(s) by an accelerating device (e.g., a particle or ion accelerating device). The device 10 and its various components may be controlled manually and/or by a controller.

In general, the device 10 may include the following:

1. Fuel for a controlled explosion;
2. A chamber to contain the fuel and to generally control and direct the explosion;
3. Additives to the fuel that may emit colors upon thermal excitation;
4. An accelerator that may direct or thrust the ignited fuel and the additives in a desired direction;
5. A controller that may control the components of the system;
6. Other elements and components, as well as various arrangements thereof, as necessary or preferred.

As described herein, the present invention may provide a controlled flame of various rich colors that may extend longer than existing devices, e.g., tens of feet or more.

Figure 1:
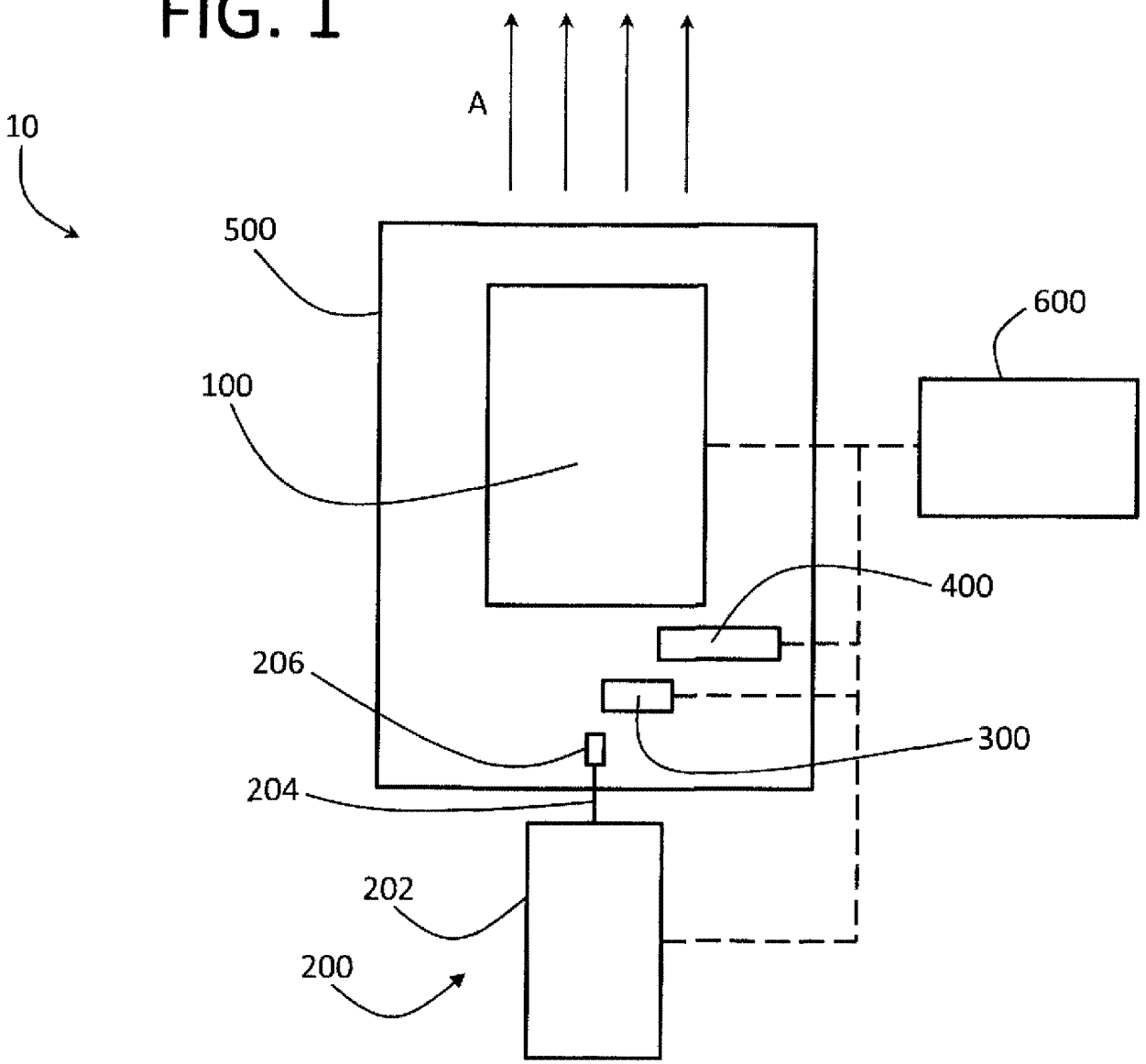
FIG. 1 shows a schematic of a colored flame emitting device.

As shown in FIG. 1, in one exemplary embodiment hereof the device 10 may include an accelerator assembly 100, a fuel source assembly 200, an ignition assembly 300, a flame coloring assembly 400, a chamber assembly 500 and a controller 600. The device 10 may also include other elements and components necessary to perform its functionalities as described in later sections or otherwise. The communication interfaces between the controller 600 and the other assemblies and/or components are represented by dashed lines. The location and orientation of the assemblies 100, 200, 300, 400, 500, 600 shown in FIG. 1 reflect an embodiment of the present invention, but the assemblies may be oriented with respect to one another in other configurations and/or in any configuration to implement the device 10.

In general, the fuel source assembly 200 may deliver fuel to or towards the input of the accelerator assembly 100 by the fuel source assembly 200 at an initial velocity. The fuel may include hydrogen ($H_2$), a mixture of hydrogen ($H_2$) and argon (Ar), or other types of fuels. The igniting assembly 300 may ignite the fuel and the flame coloring assembly 400 may add coloring agents to the ignited fuel to create desired colors. The ignited fuel with its coloring agents may enter the input of the accelerator assembly 100. The accelerator assembly 100 may then accelerate and direct and thrust the ignited fuel and coloring agents toward and out of its output (as depicted by the arrows A in FIG. 1).

Figure 2:
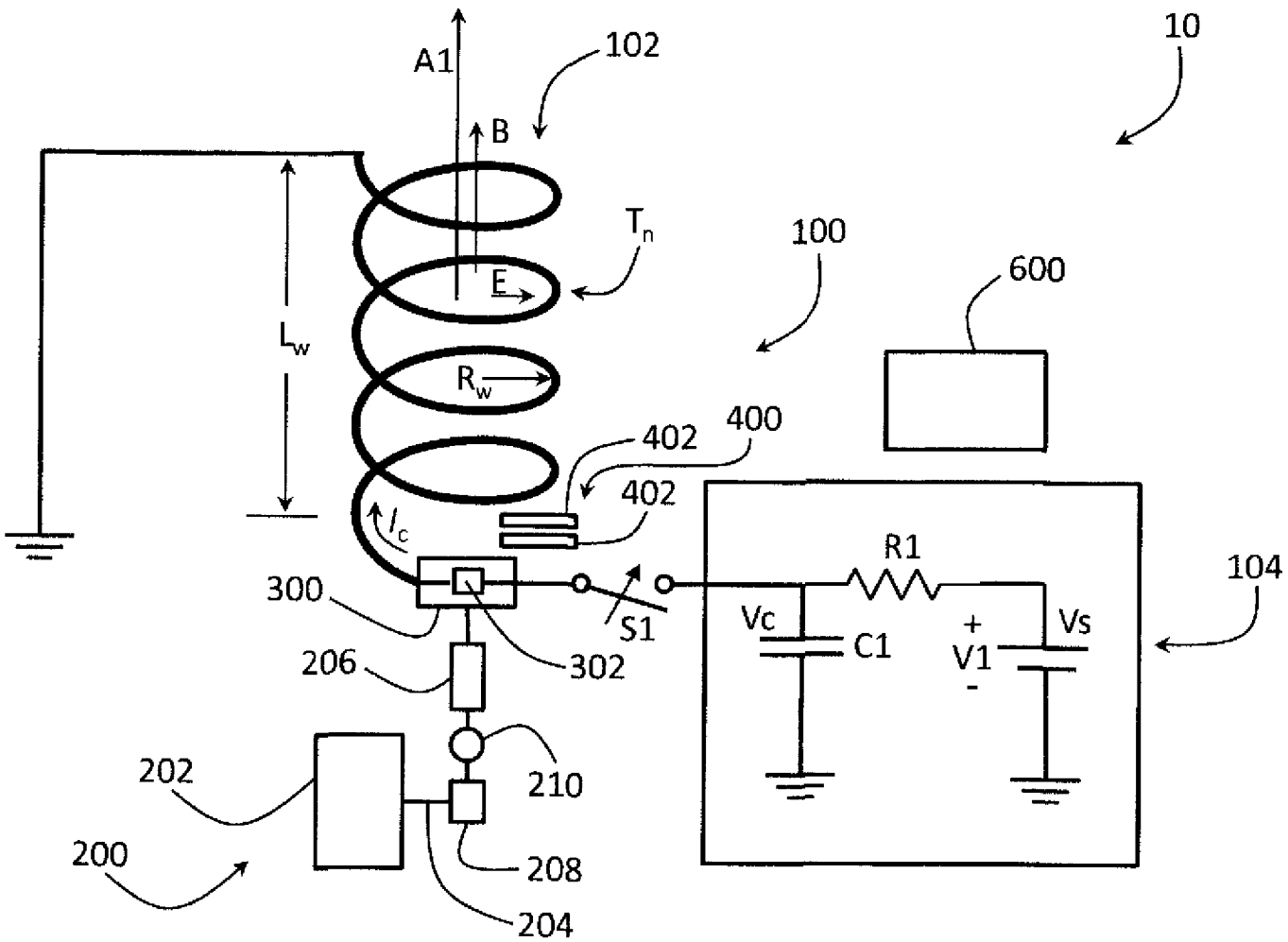
FIG. 2 shows a schematic of a colored flame emitting including certain components.

In one exemplary embodiment hereof, the fuel source assembly 200 may release a mixture of hydrogen ($H_2$) and argon (Ar) at an initial velocity to the input of the accelerator assembly 100. The ignition assembly 300 may ignite the fuel, and the fuel may immediately ionize upon ignition. The ignited and ionized particles (electrons, hydrogen ions and argon ions) may create a plasma cloud, and an electric current may form within the plasma due to the mass of electrons and positive charged ions. This current may then induce an electric field E as shown in FIG. 2.

In one exemplary embodiment hereof, the ignition of the fuel may cause an explosion, and the chamber assembly 500 may be configured to control the explosion and guide the ignited fuel into the accelerator assembly 100. It may be preferable that the initial velocity of the fuel coupled with the thrust created by the explosion be significant, and that it may be directed by the chamber assembly 500 into the accelerator 100.

In one exemplary embodiment hereof, the accelerator assembly 100 may include an electromagnetic coil 102. An electric current Ic (resulting from the discharged capacitor C1 as will be described in other sections) may flow into and through the coil 102, thus setting up a magnetic field B.

The magnetic field B may be axial with respect to the coil 102, and the electric field E may be radial with respect to the coil 102. In this way, the electromagnetic field (E and B) may apply a force to the ionized particles in the axial direction depicted as A1 in FIG. 2. This force may accelerate the cloud of ionized hydrogen and ionized argon through and out the output of the coil 102.

In addition, at the time and point of ignition (or slightly after the time and slightly in front of the point of ignition), the flame coloring assembly 400 may release a mixture of salts into the reaction. The salt molecules may undergo a thermal excitation due to the reaction such that they may release radiation within the visible light spectrum, thus adding colors of any choice to the flames. The excited salt molecules may be accelerated along with the ionized hydrogen and ionized argon particles, and the cloud of particles may accelerate through and out the output of the accelerator 100.

In this way, the device 10 may generate, control and emit a beautiful explosion of brilliantly colored flames, and the flames may be different colors, lengths, durations and/or intensity.

The system 10, its operation and the details of its various assemblies 100, 200, 300, 400, 500, 600 and components are now described in further detail.

Accelerator Assembly

As shown in FIG. 2, the device 10 may include an accelerator assembly 100 that may include an electromagnetic coil 102. The coil 102 may accelerate particles (e.g., combusting fuel, ions, etc.) that may travel from the input of the coil 102, through the coil 102, and out the output of the coil 102 (as shown by arrows A in FIG. 1).

The electromagnetic coil 102 may comprise an electrical conductor such as a wire in the shape of coil, solenoid, spiral, helix or similar. The conductor may also be referred to as a winding. The coil 102 may include a number of turns $T_n$ that may form the coil 102. The conductor may include conductive materials such as copper, silver, metal alloys, other types of materials and any combination thereof. In a preferred embodiment, the conductor may have a square or circular cross section but other shaped cross sections may also be used. The conductor may also include an outer layer of insulation, though this is not necessarily required. The conductor may also comprise superconducting wire comprising metal alloys that may be cooled with liquid nitrogen or liquid helium to cryogenic temperatures to reduce the electrical loss within the conductor.

Figure 3:
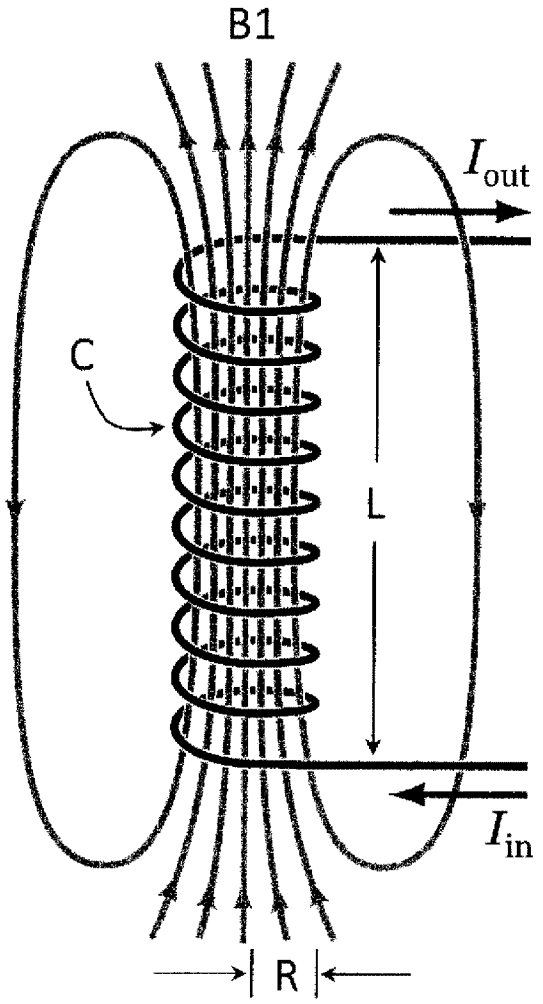
FIG. 3 shows aspects of an electromagnetic coil for use with the current invention.

As shown in FIG. 3, an electrical current I traveling into ($I_{in}$), through and out ($I_{out}$) of a coil C may create a magnetic field B1 about the coil C as shown by the arrowed field lines. The field strength of the magnetic field B may be proportional to the current I in the coil C, and can be generally defined by Ampere's law:

$$B=\mu nI$$

where $P=\mu_0\mu_r$ (magnetic permeability)

n=the number of turns per unit length in the coil C

I=the current flowing through the coil C

This expression is generally applicable to an idealized infinite length solenoid, and provides a good approximation of the field strength of the magnetic field of a long but non-infinite solenoid (where the length L of the solenoid is much greater than the radius R of the solenoid).

Returning to FIG. 2, as described above, upon ignition and ionization of the fuel at the input to the coil 102, a cloud of plasma may be created which may in turn generate an electrical current due to the free electrons and positively charged ionized particles. This electric current may be oriented axially with respect to the coil 102 and may generate an electric field E within the coil 102. The magnetic field B may be oriented axially with respect to the coil 102, and the electric field E may be oriented radially with respect to the coil 102. A particle of charge q (e.g., combusted fuel, ionized hydrogen, ionized argon, and/or thermally excited coloring salts as described in later sections) moving through the electric E and magnetic B fields at a velocity v may experience what is referred to as the Lorentz force. This force is given by the following equation:

$$F=qE+qv\times B=qE+qvB\sin\theta$$

where:

F=the force vector q=charge of the particle

E=electric field vector v=velocity of the particle

B=magnetic field vector

θ=angle between the magnetic field vector B and the particle velocity v

As shown, the first component (qE) of the Lorentz force equation may define the force exerted on a particle by the electric field E, and the second component (qvB sin θ) of the equation may define the force exerted on a particle by the magnetic field B.

Addressing the force exerted on a particle by the electric field E, because the plasma current may be axial and electric field E may be radial, the radial electric field E may shear the flow of the particles in an axial direction, thus providing acceleration to the particles as they move through the coil 102.

Figure 4:
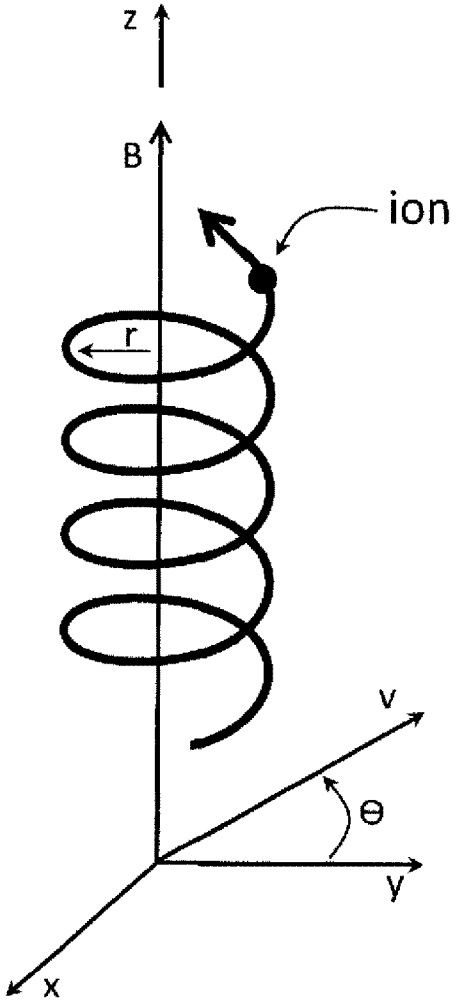
FIG. 4 shows aspects of a cyclotron orbit.

Addressing the force exerted on a particle by the magnetic field B, because the axial velocity of the particles may be parallel to the magnetic field B lines, the magnetic field B may not perform work upon the particles in the axial direction (i.e., may provide no change to the kinetic energy or speed of the particles). However, the magnetic force of the magnetic field B acting perpendicular to the component of the velocity v of the particles that may be perpendicular to the magnetic field B may cause the particles to move in a circular motion (e.g., in a spiraling path) about the magnetic field's field lines as shown in FIG. 4. This may be referred to as cyclotron motion, and may be defined as:

$$qvB=mv^2/r$$

where:

q=the charge of the particle v=the component of the velocity of the particle that is perpendicular to the magnetic field B m=the mass of the particle r=cyclotron radius The cyclotron frequency (or, equivalently, gyro-frequency) may be defined as the number of cycles a particle completes around its circular orbit every second and can be found by solving for v above and substituting in the circulation frequency, resulting in:

$$f=v/2\pi r=qB/2\pi m$$

As the ionized particles are forced into these circular paths and orbits, they may collide with non-ionized molecules causing the non-ionized particles to also ionize. This may be referred to as impact ionization. This phenomenon may have a multiplying effect on the overall reaction by increasing the ionization of the mass of particles (through impact ionization), thus increasing the current within the plasma, the magnetic field B, the electric field E and the force applied to the mass of particles, and in turn, the number of new collisions and so on. And by doing so, this may increase the acceleration of the particles through the accelerator 100.

This impact ionization may also improve (increase) the release of visible color from the coloring salts (to be described in other sections) due to the increased energy available in the reaction to thermally excite the salts, and the collisions between the electrons/ions and the salts, thereby increasing the vibrancy of the emitted colors.

The winding 102 may include as many turns $T_n$ as necessary depending on a number of factors, including but not limited to, the desired magnetic flux density of the magnetic field B, the amount of particle acceleration to be provided by the accelerator assembly 100, the size of the chamber assembly 500, the amount of fuel provided by the fuel source assembly 200, and other criteria. For example, in one preferred implementation, the coil 102 may include 50-100 turns $T_n$. In other preferred implementations, the coil 102 may include 10-50 turns $T_n$, or 100-200 or more turns $T_n$.

The radius $R_w$ and the length $L_w$ of the coil 102 may depend on a number of factors, including but not limited to, the desired amount of particle acceleration to be provided by the accelerator assembly 400, the size of the chamber 500, the amount of fuel provided by the fuel source assembly 200, and other criteria. In one preferred implementation, the radius $R_w$ may be 3-6 inches, 6-12 inches, 12-18 inches, and other sizes, and the length $L_w$ may be 12-24 inches, 24-36 inches, 36-48 inches, 48-60 inches or other lengths. Each turn of the coil 102 may generally have the same radius R. Alternatively, the radii of the turns may vary.

In a preferred embodiment, the desired magnetic flux density of the magnetic field B may be approximately 0.5 T (where T signifies the unit tesla). In other preferred implementations, the desired magnetic flux density of the magnetic field B may be 0.5 T-1.0 T, or greater. In other preferred implementations, the desired magnetic flux density of the magnetic field B may be less than 0.5 T.

In a preferred embodiment, the accelerator assembly 100 may include a voltage source and/or a current source. For example, the accelerator assembly 100 may include an RC circuit 104 as shown in FIG. 2. The RC circuit 104 may include a voltage source Vs with a voltage V1 in series with a resistor R1 and a capacitor C1. With the switch S1 open (such that the ignitor assembly 300 and the coil 102 are not electrically connected with the RC circuit 104), the capacitor C1 may be charged by the voltage source Vs through the series resistor R1. Once fully charged, the capacitor C1 may include a voltage $V_c$ across its terminals generally equal to the voltage V1 of the voltage source Vs.

Then, when the switch S1 is closed, the capacitor C1 may discharge its voltage $V_c$ to the ignitor assembly 300 which may in turn ignite the fuel supplied by the fuel source 200 and the fuel nozzle 206. In addition, the ignitor assembly 300 may act as an electrical short circuit such that the current $I_w$ flowing through the ignition assembly 300 may then flow into the coil 102 thereby creating an associated magnetic field B about the coil according to Ampere's law (shown above).

Ignition may occur before the coil 102 is activated, but the timing of these events may be varied.

In one preferred implementation, R1 may be a 1 KΩ resistor, C1 may be a 1000 μF capacitor, and Vs may be a 600 volt voltage source. However, other values of R1, C1 and Vs may also be used.

Fuel Source Assembly

In one exemplary embodiment hereof, as shown in FIGS. 1 and 2, the system 10 may include a fuel source assembly 200 that may include one or more fuel containers 202. The fuel source assembly 200 may also include one or more fuel lines 204 that may lead from the one or more fuel containers 202 to one or more fuel nozzles 206. In this way, the fuel containers 202 may provide fuel that may flow through the fuel lines 204 to the fuel nozzles 206. The fuel nozzles 206 may be positioned and oriented with respect to the accelerator assembly 100, the ignitor assembly 300, the flame coloring assembly 400 and the chamber assembly 500 to adequately provide the fuel to the device 10. For example, the fuel nozzles 206 may release the fuel at the input to the accelerator assembly 100. The fuel container(s) 202, fuel line(s) 204 and fuel nozzle(s) 206 may also include one or more valves 208 to open, close and/or regulate the fuel supply 200, and one or more fuel gauges 210 that may measure and provide information regarding the fuel pressure, the amount of fuel, the fuel temperature, the flow rate of the fuel and other information.

In one preferred embodiment, the fuel source 200 may provide fuel such as hydrogen ($H_2$) to the device 10. In another preferred embodiment, the fuel source 200 may provide a mixture of hydrogen ($H_2$) and argon (Ar). In another preferred embodiment, certain fuel sources 200 may provide hydrogen ($H_2$) and other fuel sources 200 may provide argon (Ar). In this scenario, the hydrogen ($H_2$) and argon (Ar) may be combined and mixed in the desire proportions within the fuel lines 204, at the nozzles 206 or elsewhere. It is understood that other types of fuel may also be provided by the fuel source 200 and used as the source of combustion for the system 10.

Hydrogen may be explosive in air at concentrations of about 4% to 75% (with an optimum hydrogen-to-aft ratio of 29%), and the hydrogen-oxygen reaction may be defined by the equation below:

$$2H_2(g)+O_2(g)\rightarrow 2H_2O(g)+\text{energy}$$

In addition, hydrogen may require a lower activation energy to initiate its combustion compared to many other types of fuels (e.g., a spark provided by the ignition assembly 400). Also, hydrogen combustion is more rapid than the combustion of most other fuels, and as such, the hydrogen reaction may release all of its energy very quickly. These ignition characteristics may generally limit the length or duration of any flame emitted.

Accordingly, in order to extend the burn rate of the fuel and to enlarge the resulting flames, and/or increase their duration, argon (Ar) may be included in the fuel mixture. Argon is inert (a noble gas) with a low specific heat ($C_r$) and a high specific heat ratio (κ). Argon may ionize more readily than hydrogen, and thus may lend electrons to the combusting hydrogen during the reaction, thus slowing the recombination of the hydrogen. By adding argon to the hydrogen fuel, the hydrogen reaction may be slowed, and by extending the burn rate of the reaction, the resulting flames may be thrown further by the system 10. This may result in physically longer and larger colored flames, and flames of increased duration. In addition, the slowing down of the reaction may allow the coloring salts (to be described in detail in other sections) to be better ionized as well, thus releasing more vibrant colors.

In addition, Argon may have a higher molecular mass compared to hydrogen such that it may provide larger bulk upon the fuel's release from the fuel source assembly 200. This may in turn provide a larger initial force to move the fuel (and ionized mass once ignited) into and through the accelerator 100.

The proportions of hydrogen ($H_2$) to Argon (Ar) may be 1:1. 2;1, 3:1, 4:1, 5:1, 6:1, 7:1, 8:1, 9:1, 10:1, 1:2, 1:3, 1:4, 1:5, 1:6, 1:7 but other proportions may be used. Oxygen ($O_2$) may be required for the fuel to ignite and may be provided by the fuel source assembly 200 or may be present in adequate amounts within the chamber assembly 500. Other oxidizers such as chlorine may also be utilized.

The fuel may be released by the fuel source assembly 200 at an adequate pressure and/or velocity such that the fuel, as it combusts, may enter the accelerator assembly 100 at an adequate velocity to be accelerated by the coil 102 and be emitted therefrom.

The release of the fuel from the fuel source assembly 200 may be controlled manually (e.g., by opening/closing and adjusting the fuel valve(s) 208) or may be automatically controlled, such as by the controller 600 in which case it may be preferable that the fuel valve(s) 208 be electrically controllable (e.g., controllable solenoids, etc.).

Ignition Assembly

As shown in FIGS. 1 and 2, in one exemplary embodiment hereof, the system 10 may include an ignition assembly 300 that may include a device, mechanism or circuit that may provide a spark, flame, heat or other type of ignition to ignite the fuel provided by the fuel supply assembly 200. For example, the ignition assembly 300 may include without limitation, spark gap ignitor(s), direct spark igniter(s), piezo electric ignitor(s) and other types of igniters.

In one exemplary embodiment hereof, the ignition assembly 300 may include a spark gap igniter 302 that may include two or more conducting electrodes separated by a gap filled with a gas (e.g., air) that may allow an electric spark to pass between the conductors when the potential difference between the conductors exceeds the breakdown voltage of the gas. When this happens, a spark between the electrodes may form, ionizing the gas between the electrodes and reducing the electrical resistance across the electrodes. An electrical current may then flow between the electrodes until the path of ionized gas is broken or the current is reduced below a particular value (also referred to as the holding current).

As shown in FIG. 2, the spark gap ignitor 302 may be configured in series between the capacitor C1 and the coil 102 when the switch S1 is electrically closed. In this way, the capacitor C1 may discharge its voltage V, across the spark gap ignitor 302 thereby creating a spark that may ignite the fuel released by the fuel source assembly 200. As such, it it is preferred that the fuel source assembly 200 release an adequate amount of fuel to the ignition assembly 300 just prior to or at the moment of the closing of the switch S1 and the subsequent discharging of the capacitor C1 to cause ignition of the fuel.

After the initial spark forms across the electrodes of the spark gap igniter 302 (thereby igniting the fuel), the current $I_c$ induced by the discharged voltage Vc may continue to flow across the spark gap 302 and into the coil 102 as shown. And as the current $I_c$ flows through the coil 102, the current $I_c$ may create a magnetic field B about the coil 102 that may accelerate the combusting fuel particles through the coil 102 as described above.

Flame Coloring Assembly

As shown in FIGS. 1 and 2, in one exemplary embodiment hereof, the system 10 may include a flame coloring assembly 400 that may provide additives to the fuel that may create colors in the visible spectrum. As described above, the fuel may include hydrogen ($H_2$) which, as known in the art, is highly flammable when in the presence of oxygen ($O_2$). However, the light emitted from the hydrogen ($H_2$) and oxygen ($O_2$) reaction is mainly ultraviolet, and as such, is mostly invisible to the human eye (especially during daylight).

Accordingly, the coloring assembly 400 may provide additives to the hydrogen ($H_2$) and oxygen ($O_2$) reaction that may, in turn, result in the flames emitted from the device 10 having colors in the visible spectrum. For example, the flame coloring assembly 400 may provide one or more types of salts (e.g., metal salts) to the fuel and/or to the explosion or reaction created by the ignition of the fuel, to create colors within the hydrogen-oxygen explosion.

When a salt experiences thermal excitation (e.g., via the hydrogen-oxygen explosion or reaction within the system 10), the electrons in its atomic or molecular structure may be excited and thus transferred from their normal unexcited state(s) or shells into higher energy orbitals or shells. Then, when the electrons drop back down from the higher excited orbitals or shells to their original lower orbitals or shells, quanta of energy may be released (e.g., as light), with the wavelengths of the light depending on the differences in the higher and lower energy levels experienced by the electrons. And because different atoms have different numbers of electrons in different orbits or shells, each type of atom may emit a different characteristic color/frequency of light during this phenomenon.

For example, a sodium atom in an unexcited state may have the structure $1s^2 2s^2 2p^6 3s^1$. Once excited, its outer electrons may be promoted from their normal $3s^1$ level to a higher $3p^1$ level. Then, when the electrons fall back from the $3p^1$ level to the original $3s^1$ level, an orange-yellow light may be released.

Other chemicals (e.g., metal salts) may emit other frequencies of light when heated, including:

| Chemical | Color |
|---|---|
| Lithium Chloride | Carmine (dark red) |
| Strontium Chloride | Red |
| Calcium Chloride | Orange |
| Barium Chloride | Yellow |
| Sodium Borate | Apple Green |
| Copper (II) Sulfate | Blue |
| Potassium Chloride | Peach |

The flame coloring assembly 400 may include one or more flame coloring nozzles 402 that may release one or more different types of salts into the fuel prior to being ignited, during the ignition or directly after the ignition. To facilitate the timing and release of the coloring additive(s), the flame coloring nozzles 402 may be positioned in close proximity to the output fuel nozzles 206 and/or the ignition assembly 300.

Because the thermal excitation of each type of salt may result in a different colored light, the coloring assembly 400 may include multiple flame coloring nozzles 402 that may each provide a different salt or coloring agent, and thus a different color, to the resulting light A. In this way, not only may the primary colors created by each individual salt be provided, but also the hues in between the primary colors due to the blending of the colors.

For example, different amounts of strontium chloride (red) combined with different amounts of copper sulfite (blue) may provide a wide range of green hues in the resulting flame emitted from the system 10, However, this configuration is but one example, and any combination of salts or other coloring agents may be provided to create any available visible hue of light. The flame coloring nozzles 402 may be controlled to release the coloring agents simultaneously, or in a choreographed sequence so that the colors of the resulting flames may change during their release.

The salts or other coloring agents may be combined with water and be provided as a vapor or mist, provided in powder form, or in any other form that may allow for the salts or other coloring agents to be thermally excited by the hydrogen—oxygen reaction to create the desired colors as described above.

Chamber Assembly

As shown in FIG. 1, in one exemplary embodiment hereof, the system 10 may include a chamber assembly 500 that may generally house and support the accelerator assembly 100 and other components and/or assemblies of the system 10. The chamber assembly 500 may include a housing with sides, a bottom and a top that may be at least partially open. The chamber 500 may include a circular cross-section to generally accommodate the accelerator assembly 100 (e.g., the coil 102), and other shaped cross-sections may also be used.

It may be preferable that the chamber 500 comprise a heat and flame resistant material such as ceramic, metal or other type of flame resistant materials. To this end, it is preferred that the chamber 500 be durable to withstand the heat associated with flames being emitted therefrom.

The bottom and/or sides of the chamber 500 may include ports to accommodate the fuel lines 204, fuel nozzles 206, coloring assembly 400, RC circuit 104 and to allow them to pass into the inner region of the chamber 500. The ports may also accommodate any control lines that may run from the controller 600 to-and-from the different assemblies and components housed within the chamber 500. The ports may be sealed and leak-proof so that the fuel and/or the coloring agents (salts) may not be leak from the inner region of the chamber 500 to the outside environment.

The chamber 500 may be sized, compartmentalized or otherwise configured so that components are protected from the heat associated with the ignition and emission of flames, to the extent necessary. For example, the chamber 500 may include a sub-chamber or compartment to house the ignition assembly 300 and to keep the associated heat from damaging the above referenced circuitry.

It may also be preferable that the chamber be configured to control the explosion created by the ignited fuel, and to guide and direct the ignited fuel into the accelerator assembly 200.

Controller

As noted, the system 10 may include a controller 600 that may be configured to send data to one or more of the assemblies 100, 200, 300, 400 (e.g., control commands), and/or to receive data from one or more of the assemblies 100, 200, 300, 400 (e.g., operational data). The controller 600 may include one or more microprocessors, microcontrollers, encoders, local or remote computers, smartphones, tablet computers, laptops, personal computers, hubs, servers or any other types of controller or any combination thereof. The controller 600 may include drivers to control the different assemblies 100, 200, 300, 400 and may be networked, paired or otherwise configured with one or more of the assemblies 100, 200, 300, 400 as required. The controller 600 may communicate with one or more of the assemblies 100, 200, 300, 400 via wireless technologies, Wi-Fi, Bluetooth, RF, microwave, optical, cellular or other types of wireless technologies. Alternatively the controller 600 and the assemblies 100, 200, 300, 400 may communicate via transmission lines, wires, cables, or via any combination thereof.

The controller 600 may be configured and positioned in the local proximity of the assemblies 100, 200 300, 400 and configured therewith; however, this may not be required. If the controller 600 is located in or around the chamber 500, the chamber 500 may include appropriate internal walls, partitioning or other protective measure to shield or otherwise protect the controller 600 from the heat associated with the emission of flames.

In one exemplary embodiment hereof, one or more controllers 600 may control one or more sets of assemblies 100, 200, 300, 400 such that multiple sets of assemblies 100, 200, 300, 400 may be controlled simultaneously. In this way, the flames shot by the different assemblies 100, 200, 300, 400 may be synchronized and/or choreographed with one another to create a choreographed show of colored flames. To this end, the controller 600 may be located remotely from the multiple flame emitting devices 10 and be connected to each of the devices 10 through appropriate communications means.

In Use

In one exemplary embodiment hereof, the device 10 may emit extended flames of multicolored light and/or prolonged duration. In one example, this may be achieved by the structure and configuration of the device 10, as well as the emitter device 10 performing the following steps and/or functions, without limitation:

1. The fuel source assembly 200 may provide fuel (e.g., hydrogen mixed with argon) through one or more fuel nozzles 206 to the input of the accelerator assembly 100 at an initial velocity.

2. The igniter assembly 300 is preferably positioned in close proximity to the fuel nozzles 206 so that it may ignite the fuel upon command (e.g., upon the release of the fuel). This may be accomplished by first charging the capacitor C1 with the voltage source Vs through the series resistor R1 in the RC circuit 104 with the switch S1 in its open position, and then closing the switch S1 so that the voltage $V_c$ across the capacitor C1 may discharge into the ignition assembly 300. This discharge may cause the ignition assembly 300 to spark and ignite the released fuel. It is preferred that this RC circuit 104 provide succinct control over when the fuel is ultimately ignited either a single time or multiple times. It is understood that other methods of igniting the fuel may also be used and are contemplated in this specification.

3. Upon ignition, the fuel may immediately begin to ionize, creating a cloud of plasma. The charged particles within the plasma may then generate a plasma current that may in turn generate an electric field.

4. The flame coloring assembly 400 may release different salts or other appropriate coloring agents into the fuel (prior, during or after its combustion) that may be thermally excited by the hydrogen-oxygen reaction and release light of different colors.

5. Upon causing the ignition assembly 300 to spark and ignite the fuel, the resulting current $I_c$ may flow across the ignition assembly 300 and into the coil 102.

6. As the current $I_c$ flows through the coil, it may create a magnetic field about the coil as shown in FIG. 3.

7. As the combusting/exploding fuel and thermally excited salts enter the input to the coil 102 at an initial velocity, the particles may be forced into cyclotron orbits about the magnetic field lines causing the particles to collide with non-ionized particles, resulting in the non-ionized particles to ionize due to impact ionization. The particles may also be accelerated through and out the output of the coil 102 due to the force exerted on the particles by the magnetic B and electric E fields associated with the coil 102 and the current flowing through the ionized plasma.

8. The chamber 500 may contain the hydrogen-oxygen reaction and guide the resulting flames through the accelerator 100 and out the top of the system 10.

9. The controller 600 may control the release of the fuel, the ignition of the fuel, and the release of one or more different types of salts depending on the desired colored output.

10. The controller 600 may control multiple sets of assemblies 100, 200, 300, 400 and may choreograph and/or synchronize the colored output flames from each set with each other set.

Integration of the Flame Emitting Device with Displays

In addition, the system 10 may be configured, synchronized, choreographed and/or otherwise integrated with other types of attractions such as with water displays, aerial drones, musical shows, and other types of displays or attractions. To this end, one or more of the systems 10 may be located within, adjacent to or in proximity to water, lighting or other features of the display. Also, for example, the colors of the emitted flames may match or otherwise complement the colors of LED or other lighting provided by the display, the type of music being played and/or other display effects. The length and/or duration of the colored flames may also match or complement the mode in which the display is operating, e.g., whether it is reaching a crescendo in its performance, or in an interlude.

The colored flame emitting device 10 may also be suitable for displays where color is a main feature of the display. For example, the device 10 may be integrated with the Colored Water Display of U.S. Pat. No. 10,125,952, the disclosure of which is expressly incorporated by reference as if fully set forth herein. In this example, the colored flames of the device 10 may complement the colored streams of water provided by the display. Furthermore, the colors of both the flames and water streams may be visible during daylight hours in addition to night time.

The colored flame emitting device 10 of the present invention may be integrated with other types of displays. In general, the device 10 is preferably located and activated so that the emitted flames do not pose a safety risk to observers and/or pose a risk of damage to other features of the display. One or more devices 10 may be incorporated into displays.

The colored flame emitting device 10 of the present invention may be added to existing displays as a supplemental or add-on feature, or may be included in the initial design of a display. One or more devices 10 may also be configured as a stand-alone display. To this end, one or more devices 10 may be located in public places, entries of hotels or other locations to enhance the location and/or contribute to its brand.

Those of ordinary skill in the art will appreciate and understand, upon reading this description, that embodiments hereof may provide different and/or additional advantages, and that not all embodiments or implementations need have all advantages.

A person of ordinary skill in the art will understand, that any method described above or below and/or claimed and described as a sequence of steps is not restrictive in the sense of the order of steps.

Where a process is described herein, those of ordinary skill in the art will appreciate that the process may operate without any user intervention. In another embodiment, the process includes some human intervention (e.g., a step is performed by or with the assistance of a human).

As used herein, including in the claims, the phrase "at least some" means "one or more," and includes the case of only one. Thus, e.g., the phrase "at least some ABCs" means "one or more ABCs", and includes the case of only one ABC.

As used herein, including in the claims, term "at least one" should be understood as meaning "one or more", and therefore includes both embodiments that include one or multiple components. Furthermore, dependent claims that refer to independent claims that describe features with "at least one" have the same meaning, both when the feature is referred to as "the" and "the at least one".

As used in this description, the term "portion" means some or all. So, for example, "A portion of X" may include some of "X" or all of "X". In the context of a conversation, the term "portion" means some or all of the conversation.

As used herein, including in the claims, the phrase "using" means "using at least," and is not exclusive. Thus, e.g., the phrase "using X" means "using at least X." Unless specifically stated by use of the word "only", the phrase "using X" does not mean "using only X."

As used herein, including in the claims, the phrase "based on" means "based in part on" or "based, at least in part, on," and is not exclusive. Thus, e.g., the phrase "based on factor X" means "based in part on factor X" or "based, at least in part, on factor X." Unless specifically stated by use of the word "only", the phrase "based on X" does not mean "based only on X."

In general, as used herein, including in the claims, unless the word "only" is specifically used in a phrase, it should not be read into that phrase.

As used herein, including in the claims, the phrase "distinct" means "at least partially distinct." Unless specifically stated, distinct does not mean fully distinct. Thus, e.g., the phrase, "X is distinct from Y" means that "X is at least partially distinct from Y," and does not mean that "X is fully distinct from Y." Thus, as used herein, including in the claims, the phrase "X is distinct from Y" means that X differs from Y in at least some way.

It should be appreciated that the words "first," "second," and so on, in the description and claims, are used to distinguish or identify, and not to show a serial or numerical limitation. Similarly, letter labels (e.g., "(A)", "(B)", "(C)", and so on, or "(a)", "(b)", and so on) and/or numbers (e.g., "(i)", "(ii)", and so on) are used to assist in readability and to help distinguish and/or identify, and are not intended to be otherwise limiting or to impose or imply any serial or numerical limitations or orderings. Similarly, words such as "particular," "specific," "certain," and "given," in the description and claims, if used, are to distinguish or identify, and are not intended to be otherwise limiting.

As used herein, including in the claims, the terms "multiple" and "plurality" mean "two or more," and include the case of "two." Thus, e.g., the phrase "multiple ABCs," means "two or more ABCs," and includes "two ABCs." Similarly, e.g., the phrase "multiple PQRs," means "two or more PQRs," and includes "two PQRs."

The present invention also covers the exact terms, features, values and ranges, etc. in case these terms, features, values and ranges etc. are used in conjunction with terms such as about, around, generally, substantially, essentially, at least etc. (i.e., "about 3" or "approximately 3" shall also cover exactly 3 or "substantially constant" shall also cover exactly constant).

As used herein, including in the claims, singular forms of terms are to be construed as also including the plural form and vice versa, unless the context indicates otherwise. Thus, it should be noted that as used herein, the singular forms "a," "an," and "the" include plural references unless the context clearly dictates otherwise.

Throughout the description and claims, the terms "comprise", "including", "having", and "contain" and their variations should be understood as meaning "including but not limited to", and are not intended to exclude other components unless specifically so stated.

It will be appreciated that variations to the embodiments of the invention can be made while still falling within the scope of the invention. Alternative features serving the same, equivalent or similar purpose can replace features disclosed in the specification, unless stated otherwise. Thus, unless stated otherwise, each feature disclosed represents one example of a generic series of equivalent or similar features.

The present invention also covers the exact terms, features, values and ranges, etc. in case these terms, features, values and ranges etc. are used in conjunction with terms such as about, around, generally, substantially, essentially, at least etc. (i.e., "about 3" shall also cover exactly 3 or "substantially constant" shall also cover exactly constant).

Use of exemplary language, such as "for instance", "such as", "for example" ("e.g.,") and the like, is merely intended to better illustrate the invention and does not indicate a limitation on the scope of the invention unless specifically so claimed.

While the invention has been described in connection with what is presently considered to be the most practical and preferred embodiments, it is to be understood that the invention is not to be limited to the disclosed embodiment, but on the contrary, is intended to cover various modifications and equivalent arrangements included within the spirit and scope of the appended claims.

What is claimed is:

1. A colored flame emitting device, comprising:

an electromagnetic coil having an input and an output;

a current that is provided to the electromagnetic coil thereby creating a magnetic field in a direction from the input to the output; and combustible fuel that is ignited; and a coloring agent that is added to the combustible fuel or ignited fuel;

wherein the ignited fuel is directed through the electromagnetic coil in the direction of the magnetic field and out of the output; and wherein colored visible light is emitted from the ignited fuel after leaving the output.

2. The device of claim 1 wherein the ignited fuel is a mixture of hydrogen and the coloring agent.

3. The device of claim 1 wherein the coloring agent comprises one or more salts.

4. The device of claim 1 wherein the current is provided by an RC circuit.

5. The device of claim 1 wherein the ignited fuel includes ionized particles and electrons.

6. The device of claim 5 wherein the magnetic field includes a force that causes the ionized particles and electrons to move in cyclotron orbits about the magnetic field's field lines.

7. The device of claim 1 wherein the ignited fuel creates an electric field, and the electric field accelerates the ignited fuel through the electromagnetic coil.

8. The device of claim 5 wherein the ionized particles and electrons generate a plasma current.

9. The device of claim 8 wherein the plasma current generates an electric field.

10. A method of creating a colored flame, the method comprising:

(A) providing an electromagnetic coil having an input and an output;

(B) causing a current to flow through the electromagnetic coil thereby creating magnetic field in a direction form the input to the output;

(C) igniting a combustible fuel;

(D) adding salt to the ignited fuel that become thermally excited;

(E) accelerating the ignited fuel and the salt through the electromagnetic coil in the direction of the magnetic field and out of the output, wherein the thermally excited salt emit visible colored light thereby forming the colored flame.

11. The method of claim 10 wherein the combustible fuel is hydrogen or a mixture of hydrogen and argon.

12. The method of claim 10 wherein the accelerating in (E) is caused by an electric field generated by the igniting a combustible fuel in (C).

13. The method of claim 10 wherein the current of causing a current to flow through the electromagnetic coil in (B) is provided by a voltage source in series with an RC circuit.

14. The method of claim 10 further comprising:

(C)(1) ionizing the ignited fuel.

15. The method of claim 14 further comprising:

(F) causing the ionized fuel to follow cyclotron orbits.

16. The method of claim 15 wherein the cyclotron orbits are caused by a magnetic field generated by the current caused to flow in (B).

17. The method of claim 10 further comprising:

(D)(1) thermally exciting a plurality of salts added in (D) to release multiple colors in the visible spectrum.

* * * * *